US009611012B2

(12) United States Patent
Lin et al.

(10) Patent No.: US 9,611,012 B2
(45) Date of Patent: Apr. 4, 2017

(54) LARGE-SIZED UNDERWATER TOWING DEVICE AND METHOD USING THE SAME FOR UNDERWATER TOWING

(71) Applicants: Dalian University of Technology, Dalian (CN); Yan Lin, Dalian (CN)

(72) Inventors: Yan Lin, Dalian (CN); Xiaoning Jiang, Dalian (CN); Yanyun Yu, Dalian (CN); Ming Chen, Dalian (CN); Zhikang Zhang, Dalian (CN); Chao Ye, Dalian (CN)

(73) Assignees: DALIAN UNIVERSITY OF TECHNOLOGY, Dalian (CN); Yan Lin, Dalian (CN)

( * ) Notice: Subject to any disclaimer, the term of this patent is extended or adjusted under 35 U.S.C. 154(b) by 0 days.

(21) Appl. No.: 15/145,826

(22) Filed: May 4, 2016

(65) Prior Publication Data

US 2016/0325805 A1 Nov. 10, 2016

(30) Foreign Application Priority Data

May 4, 2015 (CN) ..... 2015 1 0218651

(51) Int. Cl.
*B63B 21/66* (2006.01)
*B63B 21/16* (2006.01)

(52) U.S. Cl.
CPC ..... *B63B 21/66* (2013.01); *B63B 21/16* (2013.01); *B63B 2207/02* (2013.01); *B63B 2702/02* (2013.01)

(58) Field of Classification Search
CPC ..... B63B 21/16; B63B 21/56; B63B 21/66
USPC ..... 114/244, 245, 253
See application file for complete search history.

(56) References Cited

U.S. PATENT DOCUMENTS 4,055,138 A * 10/1977 Klein ..... B63B 21/66 114/244
4,586,452 A * 5/1986 Lapetina ..... B63B 21/66 114/245
7,666,045 B2 * 2/2010 Nigel ..... B63B 22/18 114/244

* cited by examiner

*Primary Examiner* — Lars A Olson
(74) *Attorney, Agent, or Firm* — Matthias Scholl, PC; Matthias Scholl

(57) ABSTRACT

An underwater towing device, including an underwater towing assembly and a fixing mechanism of the underwater towing assembly. The underwater towing assembly includes a first floating body, a second floating body, and a third floating body. The fixing mechanism includes a fairlead carrier and two supports disposed on two sides of the fairlead carrier. The first floating body, the second floating body, and the third floating body are connected together via a fixing frame. The first floating body, the second floating body, and the third floating body have streamlined and bilaterally symmetrical shapes and all are hollow to accommodate experimental equipment. The first floating body is a cylinder having a drop-shaped horizontal cross-section. The upper part of the first floating body is provided with a buoyancy reserve tank having an elliptic horizontal cross-section.

5 Claims, 10 Drawing Sheets

LARGE-SIZED UNDERWATER TOWING DEVICE AND METHOD USING THE SAME FOR UNDERWATER TOWING

CROSS-REFERENCE TO RELATED APPLICATIONS

Pursuant to 35 U.S.C. §119 and the Paris Convention Treaty, this application claims the foreign priority benefit of Chinese Patent Application No. 201510218651.2 filed May 4, 2015, the contents of which, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, and Cambridge, Mass. 02142.

BACKGROUND OF THE INVENTION

Field of the Invention

The invention relates to a large-sized underwater towing device and a method using the same for underwater towing.

Description of the Related Art

Existing towing devices are small-sized, and unable to carry large experimental equipment. In addition, the disposition of the towing devices is inconvenient and occupies much storage space on the deck of a ship.

SUMMARY OF THE INVENTION

In view of the above-described problems, it is one objective of the invention to provide a large-sized underwater towing device and a method using the same for underwater towing. The underwater towing device has a reasonable structure and can be conveniently mounted on the deck to lift up, lower down, and draw an object with appropriate floating state and direction stability.

To achieve the above objective, in accordance with one embodiment of the invention, there is provided a large-sized underwater towing device, comprising an underwater towing assembly and a fixing mechanism of the underwater towing assembly. The underwater towing assembly comprises a first floating body, a second floating body, and a third floating body. The first floating body, the second floating body, and the third floating body are connected together via a fixing frame. The first floating body, the second floating body, and the third floating body have streamlined and bilaterally symmetrical shapes and all are hollow to accommodate experimental equipment. The first floating body is a cylinder having a drop-shaped horizontal cross-section. An upper part of the first floating body is provided with a buoyancy reserve tank having an elliptic horizontal cross-section.

Between the first floating body and the buoyancy reserve tank is provided with an adapter. A tail of the second floating body is provided with first vertical guiding spoilers and a first horizontal guiding spoilers. A tail of the third floating body is provided with second vertical guiding spoilers and a second horizontal guiding spoilers. The fixing frame comprises an upper frame and a lower frame; the upper frame is fixedly connected to the lower frame. The upper frame comprises an upper rectangular frame and a first circular tube on a diagonal of the upper rectangular frame. The first floating body is fixed on a center of the first circular tube, and four diagonal braces are connected to the first floating body and four corners of the upper rectangular frame. The lower frame comprises six second circular tubes horizontally arranged, a lower rectangular frame, four third circular tubes vertically arranged, three fourth circular tubes which are arc-shaped and collision-proof, two sleigh-shaped members, and two seat boards. The second circular tubes, the lower rectangular frame, the third circular tubes, the fourth circular tubes, the sleigh-shaped members, and the seat boards are fixedly connected together. The second floating body and the third floating body are fixedly connected to the lower frame.

The fixing mechanism comprises a fairlead carrier and two supports disposed on two sides of the fairlead carrier. One end of the fairlead carrier is fixed on the deck of a stern, and another end of the fairlead carrier is connected to a diagonal tie bar of the fairlead carrier. A top of the fairlead carrier is provided with a fairlead. One end of a towing steel cable passes through the fairlead and is connected to a steel cable connecting hole on the sleigh-shaped members, and another end of the towing steel cable is connected to a winch. The supports are supported by a vertical support rob on a central part of the supports. One end of the supports is fixed on the deck of the stern, and another end of the supports is connected to lifting hooks corresponding to two lifting hook holes on the sleigh-shaped members via a hoist cable. A vertical slab of a tail end of a ship hull is provided with a bumper pad.

In a class of this embodiment, a first ear plate of the upper rectangular frame is fixedly connected to a second ear plate of the lower rectangular frame via a first pair of screw bolt and nut.

In a class of this embodiment, a third ear plate of the second floating body is fixedly connected to a fourth ear plate of the second circular tubes via a second pair of screw bolt and nut.

In a class of this embodiment, a fifth ear plate of the third floating body is fixedly connected to a sixth ear plate of an extended circular tube via a third pair of screw bolt and nut.

A method for underwater towing using the underwater towing device comprises the following steps:

1) in the initial state, connecting the two lifting hooks of the supports to the two lifting hook holes of one of the sleigh-shaped members of the underwater towing assembly; allowing one end of the towing steel cable to wind the fairlead and connect to the steel cable connecting hole on the sleigh-shaped members;

2) actuating the winch to tension the towing steel cable and lift the underwater towing assembly up; disconnecting the two lifting hooks from the lifting hook holes; actuating the winch reversely to loosen the towing steel cable and lower down the underwater towing assembly into the water; allowing the ship hull to tow the underwater towing assembly, and performing an experiment;

3) actuating the winch to tension the towing steel cable and lift the underwater towing assembly up; connecting the two lifting hooks to the lifting hook holes; actuating the winch reversely to loosen the towing steel cable; hanging the underwater towing assembly by the two lifting hooks, thus the underwater towing assembly turns at ninety degrees; allowing the underwater towing assembly to lean against the bumper pad disposed on the vertical slab of the tail end of the ship hull.

Advantages of the underwater towing device according to embodiments of the invention are summarized as follows: the large-sized underwater towing device comprises an underwater towing assembly and a fixing mechanism. The underwater towing assembly comprises a first floating body, a second floating body, and a third floating body. The first floating body, the second floating body, and the third floating body are connected together via a fixing frame. The fixing frame comprises an upper frame and a lower frame; the upper frame is fixedly connected to the lower frame. The upper frame comprises an upper rectangular frame and a first circular tube on a diagonal of the upper rectangular frame. The first floating body is fixed on a center of the first circular tube. The second floating body and the third floating body are fixedly connected to the lower frame. The fixing mechanism comprises a fairlead carrier and two supports disposed on two sides of the fairlead carrier. A towing steel cable passes through the fairlead and is connected to a steel cable connecting hole on the sleigh-shaped members. The supports are connected to lifting hooks corresponding to two lifting hook holes on the sleigh-shaped members via a hoist cable. A vertical slab of a tail end of a ship hull is provided with a bumper pad. The underwater towing device has a reasonable structure and can be conveniently mounted on the deck to lift up, lower down, and draw an object with appropriate floating state and direction stability.

BRIEF DESCRIPTION OF THE DRAWINGS

The invention is described hereinbelow with reference to the accompanying drawings, in which.

Figure 1:
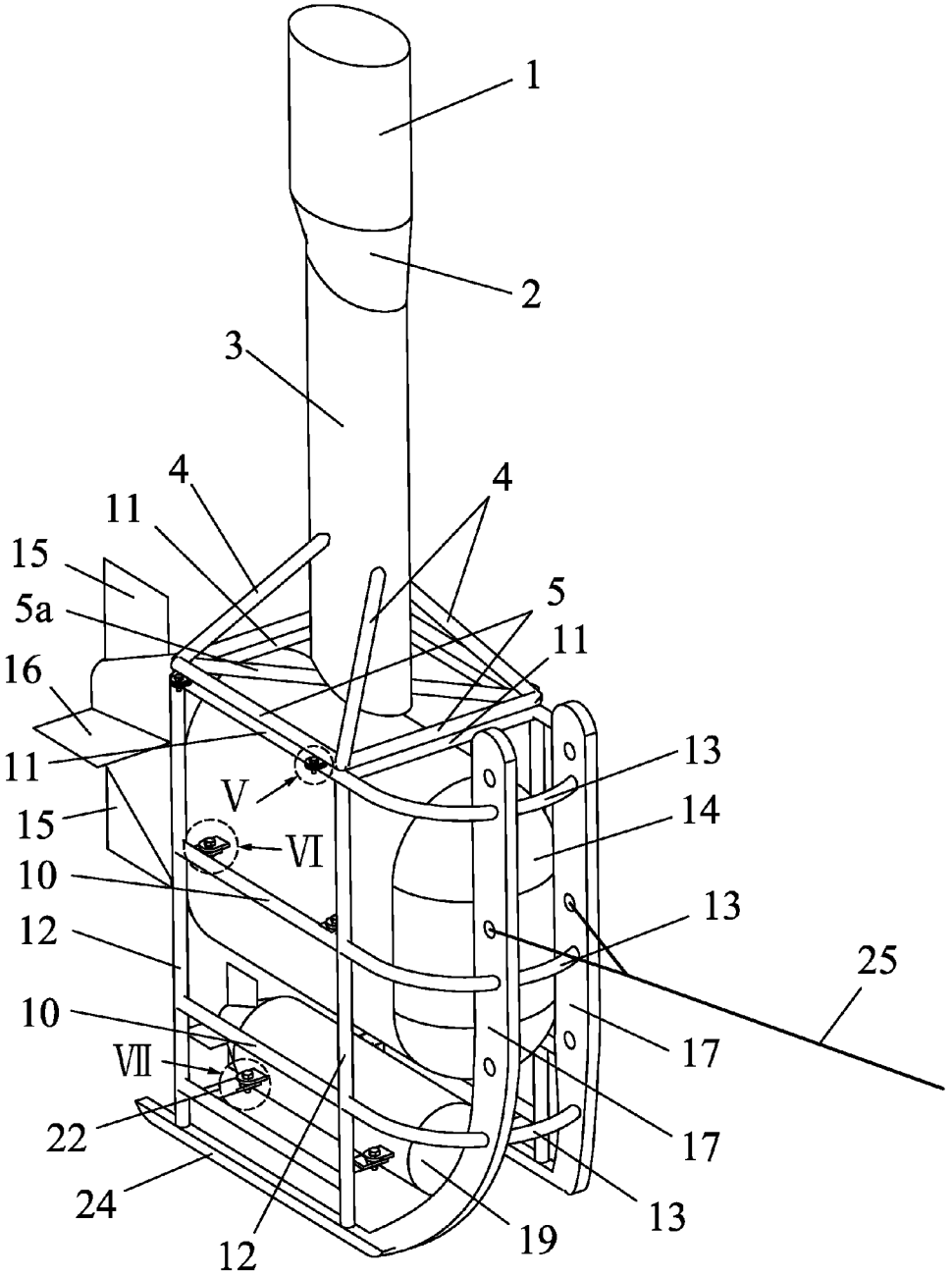
FIG. 1 is a schematic diagram of a large-sized underwater towing device in accordance with one embodiment of the invention.
Figure 2:
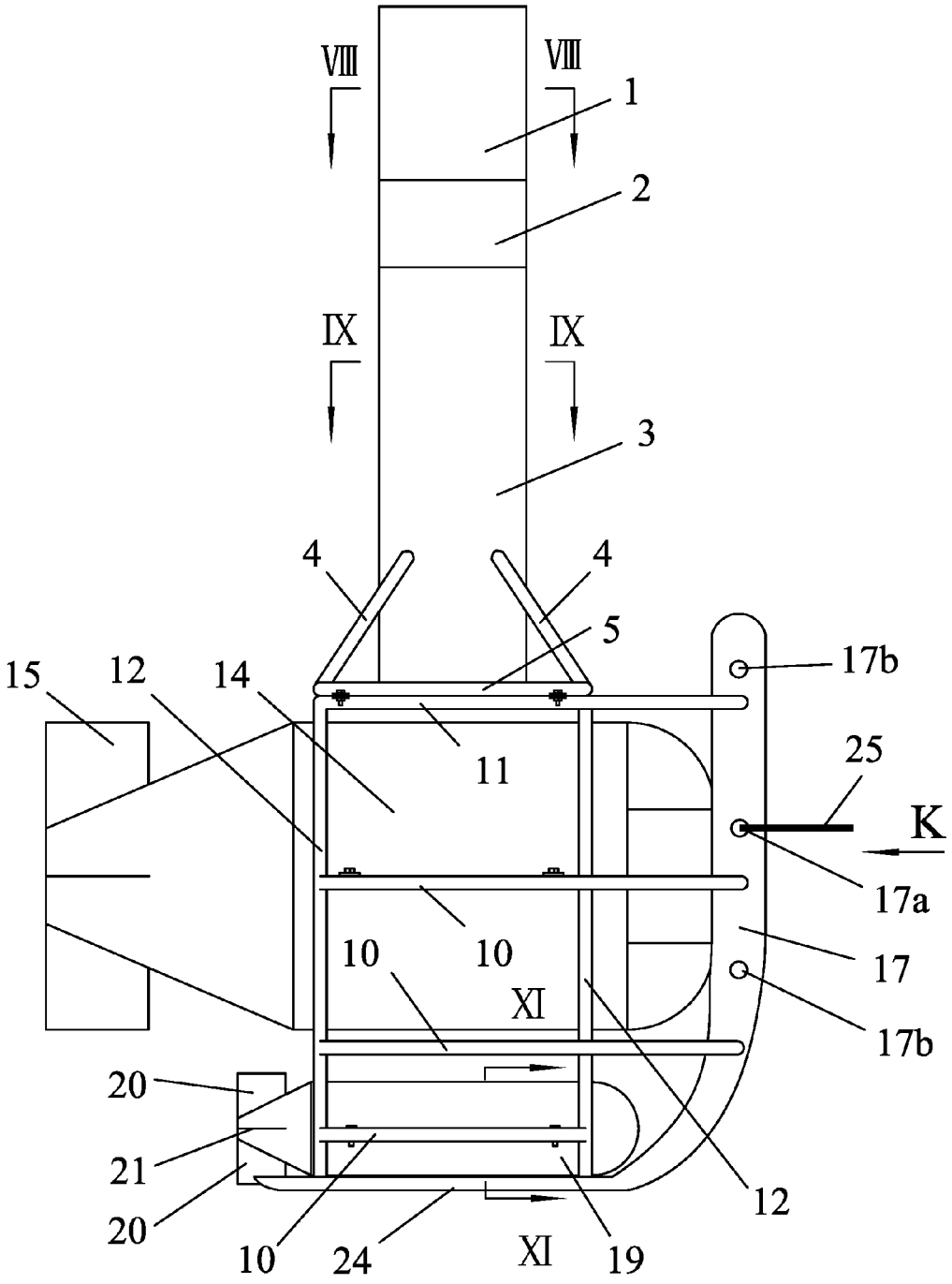
FIG. 2 is a front view of a large-sized underwater towing device in accordance with one embodiment of the invention.
Figure 3:
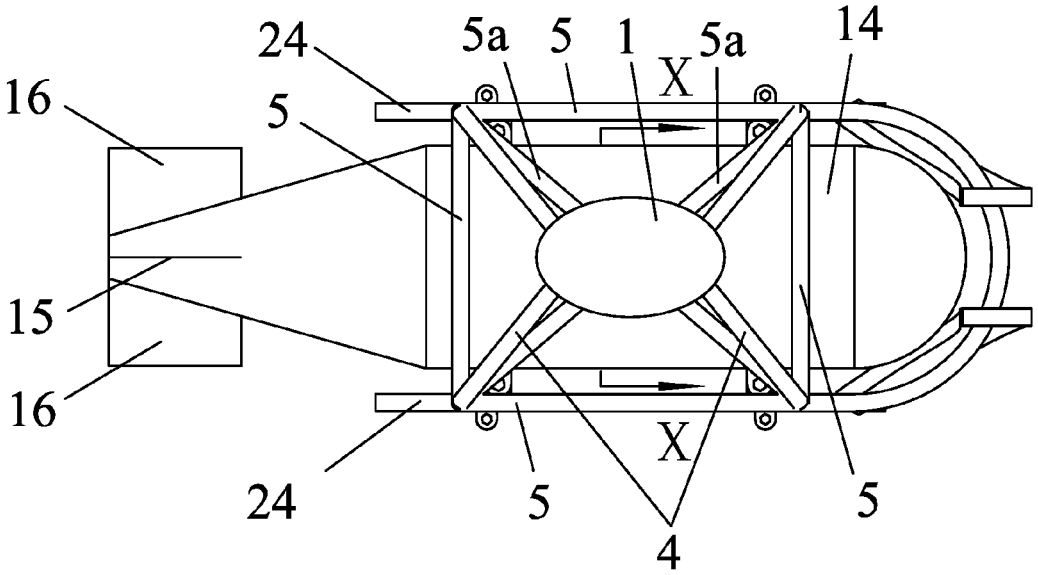
FIG. 3 is a top view of a large-sized underwater towing device in accordance with one embodiment of the invention.
Figure 4:
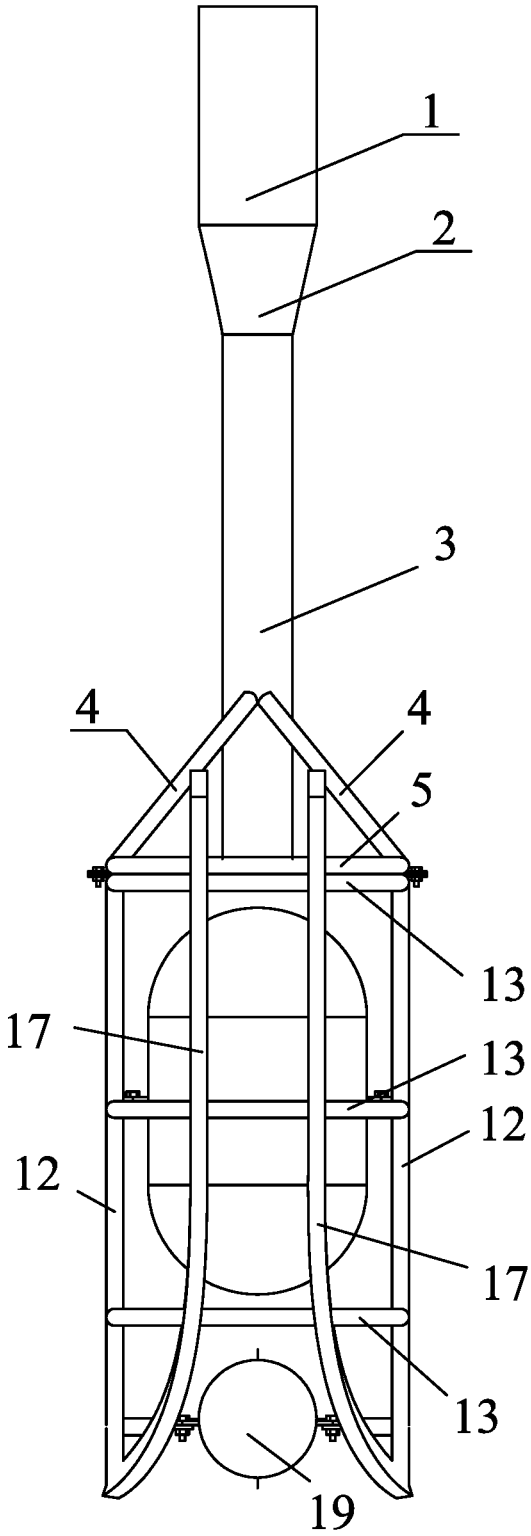
FIG. 4 is a view taken from direction K in FIG. 2.

In the drawings, the following reference numbers are used: 1. Buoyancy reserve tank; 2. Adapter; 3. First floating body; 4. Diagonal braces; 5. Upper rectangular frame; 5*a*. First circular tube; 6. First ear plate; 7. Second ear plate; 7*a*. Fourth ear plate; 7*b*. Sixth ear plate; 8. Screw bolt; 9. Nut; 10. Second circular tubes; 11. Lower rectangular frame; 12. Third circular tubes; 13. Fourth circular tubes; 14. Second floating body; 15. First vertical guiding spoilers; 16. First horizontal guiding spoilers; 17. Sleigh-shaped members; 17*a*. Steel cable connecting hole; 17*b*. Lifting hook holes; 18. Third ear plate; 19. Third floating body; 20. Second vertical guiding spoilers; 21. Second horizontal guiding spoilers; 22. Extended circular tube; 23. Fifth ear plate; 24. Seat boards; 25. Towing steel cable; 26. Winch; 27. Supports; 28. Vertical support rob; 29. Hoist cable; 30. Lifting hooks; 31. Diagonal tie bar; 32. Fairlead carrier; 33. Broken-line-shaped Board; 34. Axle; 35. Fairlead; 36. Bumper pad; 37. Ship hull; and 38. Deck.

DETAILED DESCRIPTION OF THE EMBODIMENTS

For further illustrating the invention, experiments detailing a large-sized underwater towing device and a method using the same for underwater towing are described below. It should be noted that the following examples are intended to describe and not to limit the invention.

Figure 8:
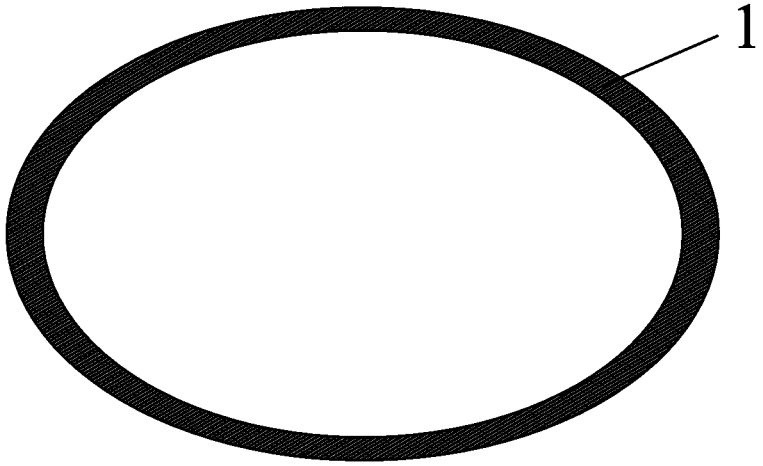
FIG. 8 is a cross-sectional view taken from line VIII-VIII in FIG. 2.
Figure 9:
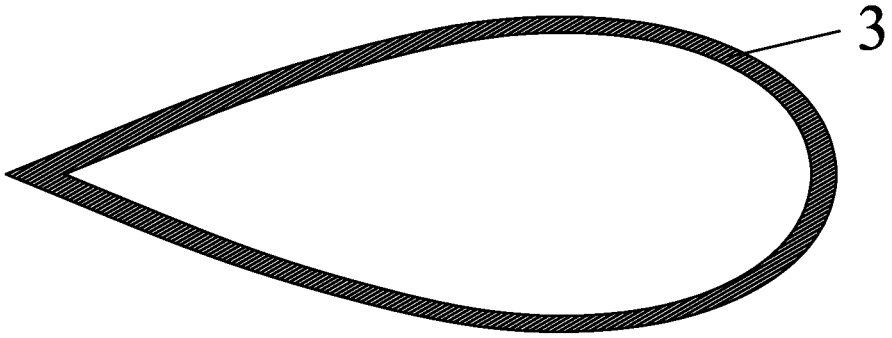
FIG. 9 is a cross-sectional view taken from line IX-IX in FIG. 2.
Figure 10:
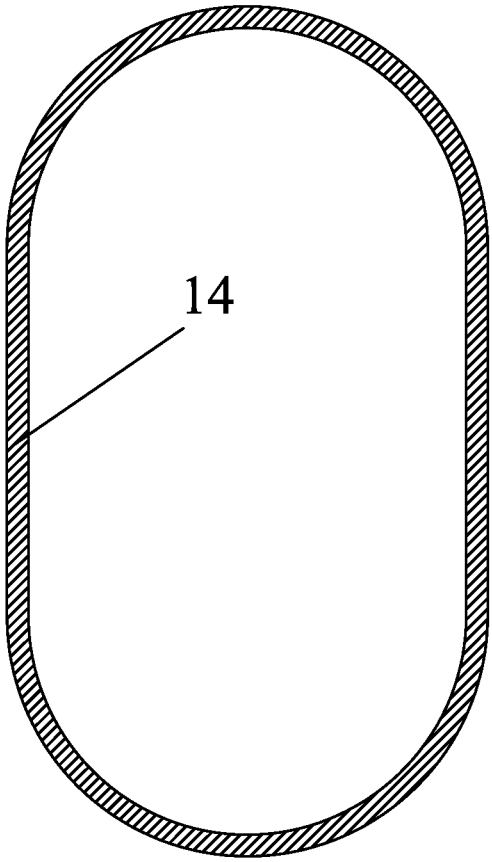
FIG. 10 is a cross-sectional view taken from line X-X in FIG. 3.
Figure 11:
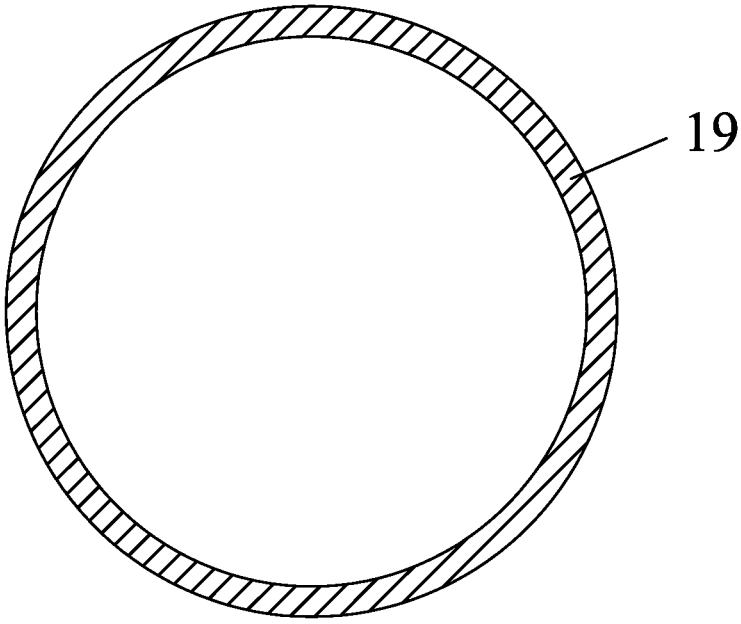
FIG. 11 is a cross-sectional view taken from line XI-XI in FIG. 2.
Figure 12:
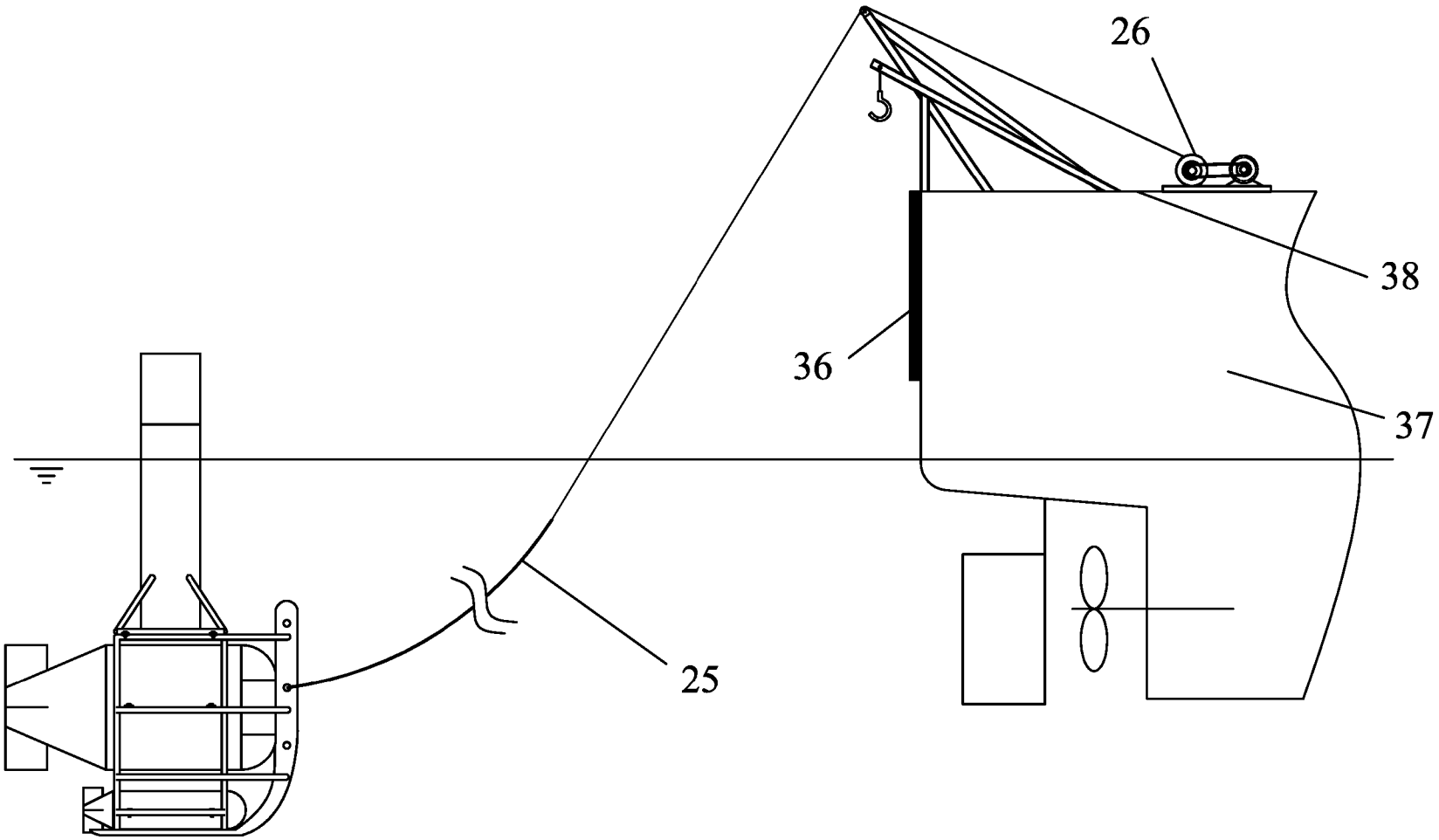
FIG. 12 is a diagram showing a working condition of a large-sized underwater towing device in accordance with one embodiment of the invention.
Figure 13:
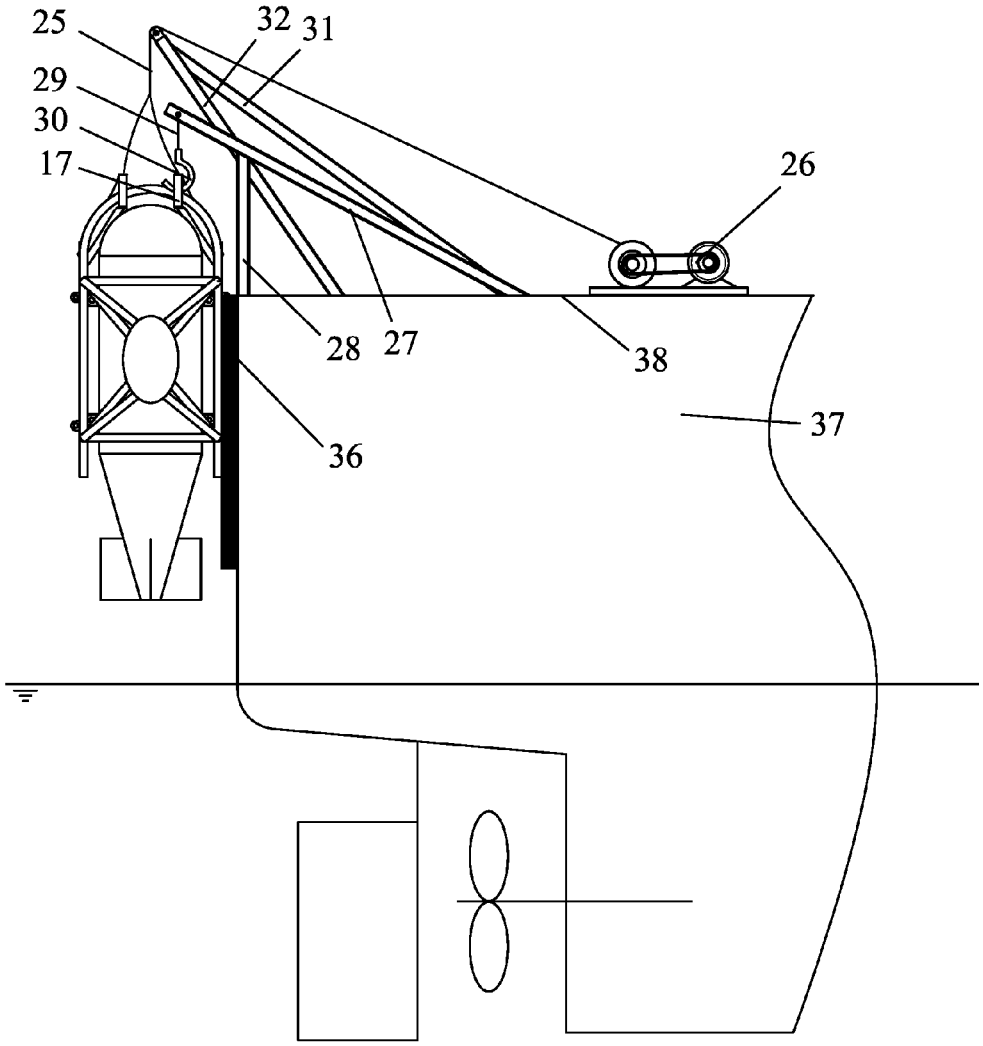
FIG. 13 is a front view of a large-sized underwater towing device when being lifted up and disposed on a stern in accordance with one embodiment of the invention.
Figure 14:
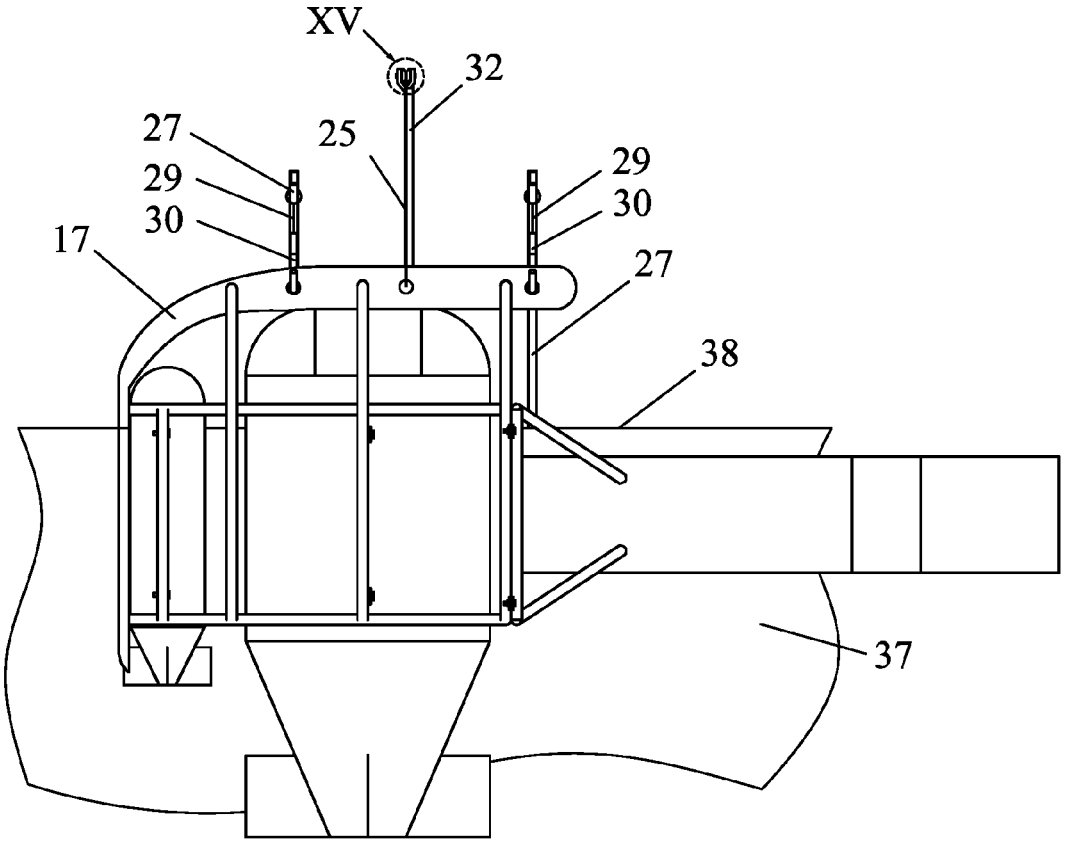
FIG. 14 is a side view of a large-sized underwater towing device when being lifted up and disposed on a stern in accordance with one embodiment of the invention.
Figure 15:
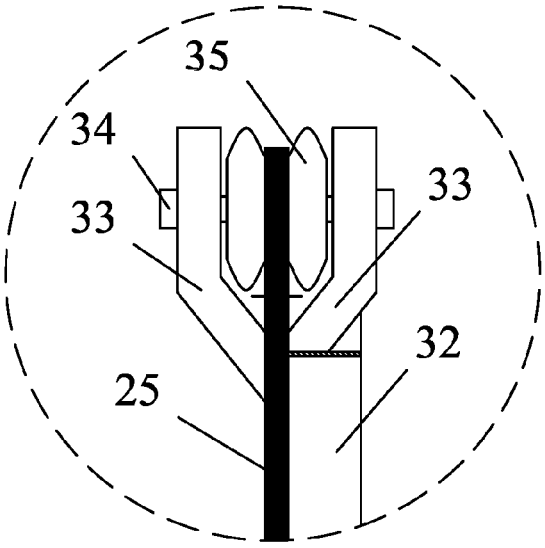
FIG. 15 is a partial enlarged view taken from part XV in FIG. 14.

FIGS. 1-4 are schematic diagrams of a large-sized underwater towing device. The large-sized underwater towing device comprises an underwater towing assembly and a fixing mechanism on a deck of a stern. The underwater towing assembly comprises a first floating body 3, a second floating body 14, and a third floating body 19. The first floating body 3, the second floating body 14, and the third floating body 19 are connected together via a fixing frame. The first floating body 3, the second floating body 14 (as shown in FIG. 10), and the third floating body 19 (as shown in FIG. 11) have streamlined and bilaterally symmetrical shapes. The first floating body 3, the second floating body 14, and the third floating body 19 are hollow so as to accommodate experimental equipment. The first floating body 3 is a cylinder having a drop-shaped (as shown in FIG. 9) horizontal cross-section. An upper part of the first floating body 3 is provided with a buoyancy reserve tank 1 having an elliptic (as shown in FIG. 8) horizontal cross-section. Between the first floating body 3 and the buoyancy reserve tank 1 is provided with an adapter 2. A tail of the second floating body 14 is provided with first vertical guiding spoilers 15, and a first horizontal guiding spoilers 16. A tail of the third floating body 19 is provided with second vertical guiding spoilers 20, and a second horizontal guiding spoilers 21. The fixing frame comprises an upper frame and a lower frame; the upper frame is fixedly connected to the lower frame. The upper frame comprises an upper rectangular frame 5 and a first circular tube 5*a* on a diagonal of the upper rectangular frame. The first floating body 3 is fixed on a center of the first circular tube 5*a*, and four diagonal braces 4 are connected to the first floating body 3 and four corners of the upper rectangular frame 5. The lower frame comprises six second circular tubes 10 horizontally arranged, a lower rectangular frame 11, four third circular tubes 12 vertically arranged, three fourth circular tubes 13 which are arc-shaped and collision-proof, two sleigh-shaped members 17, and two seat boards 24. The second circular tubes 10, the lower rectangular frame 11, the third circular tubes 12, the fourth circular tubes 13, the sleigh-shaped members 17, and the seat boards 24 are fixedly connected together. The second floating body 14 and the third floating body 19 are fixedly connected to the lower frame.

Figure 5:
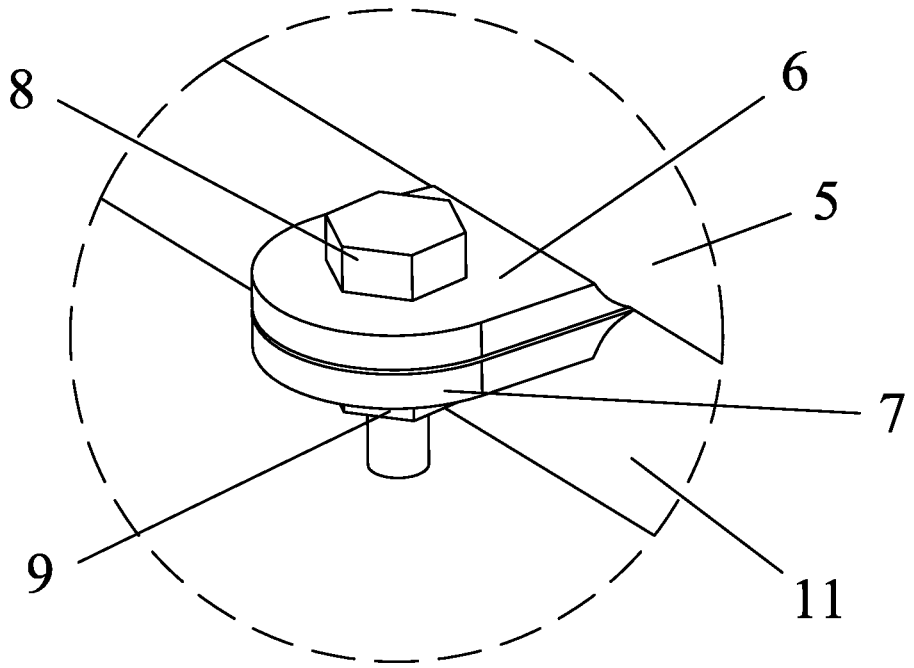
FIG. 5 is a partial enlarged view taken from part V in FIG. 1.

FIG. 5 is a diagram showing a connection between the upper frame and the lower frame. Four first ear plates 6 of the upper rectangular frame 5 of the upper frame are fixedly connected to four second ear plates 7 of the lower rectangular frame 11 of the lower frame via first pairs of screw bolts 8 and nuts 9.

Figure 6:
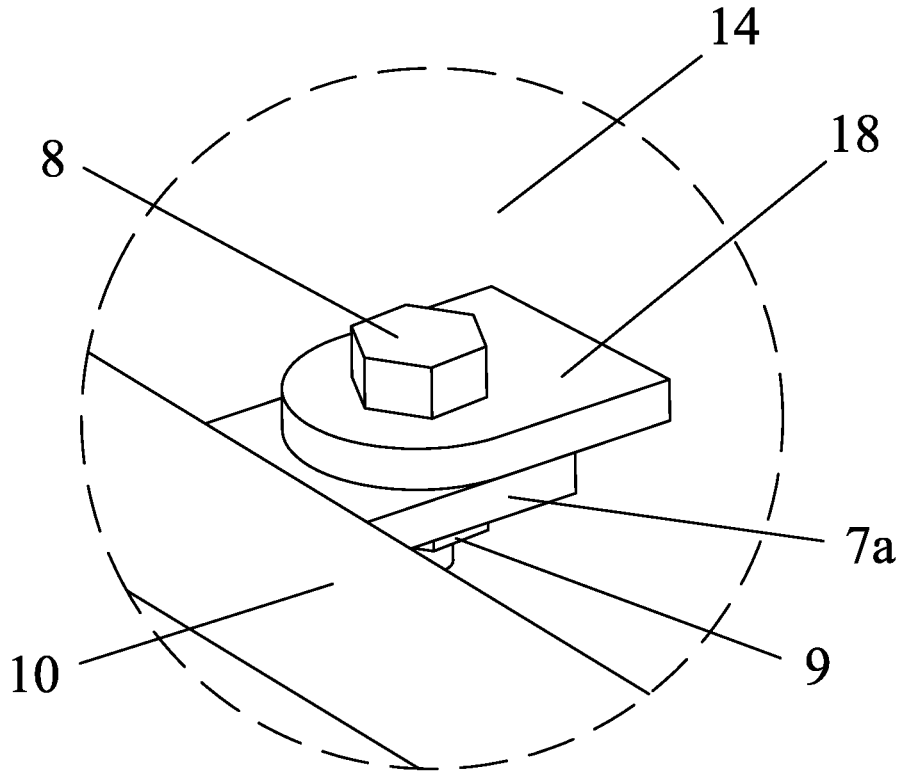
FIG. 6 is a partial enlarged view taken from part VI in FIG. 1.

FIG. 6 is a diagram showing a fixation of the second floating body. Four third ear plates 18 of the second floating body 14 are fixedly connected to four fourth ear plates 7*a* of the second circular tubes 10 via second pairs of screw bolts 8 and nuts 9.

Figure 7:
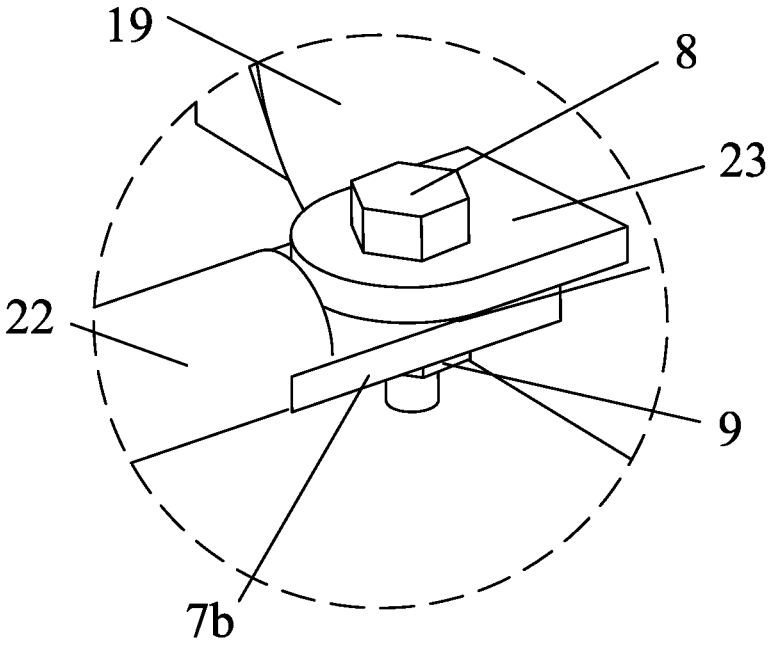
FIG. 7 is a partial enlarged view taken from part VII in FIG. 1.

FIG. 7 is diagram showing a fixation of the third floating body. Four fifth ear plates 23 of the third floating body 19 are fixedly connected to four sixth ear plates 7*b* of an extended circular tube 22 via third pairs of screw bolts 8 and nuts 9.

FIGS. 12-15 are diagrams showing working conditions of the large-sized underwater towing assembly and a structure of the fixing mechanism. The fixing mechanism comprises a fairlead carrier 32 and two supports 27 disposed on two sides of the fairlead carrier 32. One end of the fairlead carrier 32 is fixed on the deck 38 of the stern, and another end of the fairlead carrier is connected to a diagonal tie bar 31 of the fairlead carrier. A top of the fairlead carrier 32 is provided with a fairlead 35. One end of a towing steel cable 25 passes through the fairlead and is connected to a steel cable connecting hole 17*a* on the sleigh-shaped members 17, another end of the towing steel cable is connected to a winch 26. The supports 27 are supported by a vertical support rob 28 on a central part of the supports. One end of the supports 27 is fixed on the deck 38 of the stern, and another end of the supports 27 is connected to lifting hooks 30 corresponding to two lifting hook holes 17*b* on the sleigh-shaped members 17 via a hoist cable 29. A vertical slab of a tail end of a ship hull 37 is provided with a bumper pad 36.

A method for underwater towing using the large-sized underwater towing device comprises the following steps:

1) In the initial state, connecting the two lifting hooks 30 of the supports 27 to the two lifting hook holes 17*b* of one of the sleigh-shaped members 17 of the underwater towing assembly; allowing one end of the towing steel cable 25 to wind the fairlead 35 and connect to the steel cable connecting hole 17*a* on the sleigh-shaped members 17;

2) Actuating the winch 26 to tension the towing steel cable 25 and lift the underwater towing assembly up; disconnecting the two lifting hooks 30 from the lifting hook holes 17*b;* actuating the winch 26 reversely to loosen the towing steel cable 25 and lower down the underwater towing assembly into the water; allowing the ship hull 37 to tow the underwater towing assembly, and performing an experiment;

3) Actuating the winch 26 to tension the towing steel cable 25 and lift the underwater towing assembly up; connecting the two lifting hooks 30 to the lifting hook holes 17*b;* actuating the winch 26 reversely to loosen the towing steel cable 25; hanging the underwater towing assembly by the two lifting hooks 30, thus the underwater towing assembly turns at ninety degrees; allowing the underwater towing assembly to lean against the bumper pad 36 disposed on the vertical slab of the tail end of the ship hull 37.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. An underwater towing device, comprising:

an underwater towing assembly, the underwater towing assembly comprising a first floating body, a second floating body, a third floating body, and a fixing frame; and a fixing mechanism of the underwater towing assembly, the fixing mechanism being disposed on a deck and comprising a fairlead carrier and two supports disposed on two sides of the fairlead carrier;

wherein the first floating body, the second floating body, and the third floating body are connected together via the fixing frame; the first floating body, the second floating body, and the third floating body have streamlined and bilaterally symmetrical shapes and are all hollow so as to accommodate experimental equipment; the first floating body is a cylinder having a drop-shaped horizontal cross-section; an upper part of the first floating body is provided with a buoyancy reserve tank having an elliptic horizontal cross-section;

between the first floating body and the buoyancy reserve tank is provided with an adapter; a tail of the second floating body is provided with first vertical guiding spoilers and first horizontal guiding spoilers; a tail of the third floating body is provided with second vertical guiding spoilers and second horizontal guiding spoilers;

the fixing frame comprises an upper frame and a lower frame; the upper frame is fixedly connected to the lower frame; the upper frame comprises an upper rectangular frame and a first circular tube on a diagonal of the upper rectangular frame; the first floating body is fixed on a center of the first circular tube, and four diagonal braces are connected to the first floating body and four corners of the upper rectangular frame; the lower frame comprises six second circular tubes horizontally arranged, a lower rectangular frame, four third circular tubes vertically arranged, three fourth circular tubes which are arc-shaped and collision-proof, two sleigh-shaped members, and two seat boards; the second circular tubes, the lower rectangular frame, the third circular tubes, the fourth circular tubes, the sleigh-shaped members, and the seat boards are fixedly connected together; the second floating body and the third floating body are fixedly connected to the lower frame;

one end of the fairlead carrier is fixed on the deck, and another end of the fairlead carrier is connected to a diagonal tie bar of the fairlead carrier; a top of the fairlead carrier is provided with a fairlead; one end of a towing steel cable passes through the fairlead and is connected to a steel cable connecting hole on the sleigh-shaped members, another end of the towing steel cable is connected to a winch; the supports are supported by a vertical support rob on a central part of the supports; one end of the supports is fixed on the deck, and another end of the supports is connected to lifting hooks corresponding to two lifting hook holes on the sleigh-shaped members via a hoist cable; a vertical slab of a tail end of a ship hull is provided with a bumper pad.

2. The towing assembly of claim 1, wherein a first ear plate of the upper rectangular frame is fixedly connected to a second ear plate of the lower rectangular frame via a first pair of screw bolt and nut.

3. The towing assembly of claim 1, wherein a third ear plate of the second floating body is fixedly connected to a fourth ear plate of the second circular tubes via a second pair of screw bolt and nut.

4. The towing assembly of claim 1, wherein a fifth ear plate of the third floating body is fixedly connected to a sixth ear plate of an extended circular tube via a third pair of screw bolt and nut.

5. A method for underwater towing using the underwater towing device of claim 1, the method comprising:

1) in an initial state, connecting the two lifting hooks of the supports to the two lifting hook holes of one of the sleigh-shaped members of the underwater towing assembly; allowing one end of the towing steel cable to wind the fairlead and connect to the steel cable connecting hole on the sleigh-shaped members;

2) actuating the winch to tension the towing steel cable and lift the underwater towing assembly up; disconnecting the two lifting hooks from the lifting hook holes; actuating the winch reversely to loosen the towing steel cable and lower down the underwater towing assembly into water; allowing the ship hull to tow the underwater towing assembly, and performing an experiment; and 3) actuating the winch to tension the towing steel cable and lift the underwater towing assembly up; connecting the two lifting hooks to the lifting hook holes; actuating the winch reversely to loosen the towing steel cable; hanging the underwater towing assembly by the two lifting hooks, where the underwater towing assembly turns at ninety degrees; allowing the underwater towing assembly to lean against the bumper pad disposed on the vertical slab of the tail end of the ship hull.

* * * * *